US009451352B2

(12) United States Patent
Son et al.

(10) Patent No.: US 9,451,352 B2
(45) Date of Patent: Sep. 20, 2016

(54) UNLOCKING APPARATUS AND METHOD USING EAR-MICRO HEADSET IN TERMINAL

(71) Applicant: Samsung Electronics Co., Ltd., Suwon-si, Gyeonggi-do (KR)

(72) Inventors: Dong-Il Son, Cheongju-si (KR); Jae-Yung Yeo, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 192 days.

(21) Appl. No.: 14/077,954

(22) Filed: Nov. 12, 2013

(65) Prior Publication Data

US 2014/0133671 A1 May 15, 2014

(30) Foreign Application Priority Data

Nov. 14, 2012 (KR) ..... 10-2012-0129130

(51) Int. Cl.
*H04R 1/10* (2006.01)
*H04R 5/033* (2006.01)

(52) U.S. Cl.
CPC ..... *H04R 1/1041* (2013.01); *H04R 5/0335* (2013.01); *H04R 1/10* (2013.01)

(58) Field of Classification Search
CPC ..... H04R 5/033; H04R 1/1041; H04R 1/10; H04R 5/0335
USPC ..... 381/74, 77, 81, 367, 370–371, 381/380–381, 110
See application file for complete search history.

(56) References Cited

U.S. PATENT DOCUMENTS

| | | | | |
|---|---|---|---|---|
| 7,181,024 | B1 * | 2/2007 | Oba | H04B 13/005 381/74 |
| 2003/0007649 | A1 * | 1/2003 | Riggs | G11B 19/027 381/86 |
| 2010/0075723 | A1 | 3/2010 | Min et al. | |
| 2012/0189134 | A1 * | 7/2012 | Wang | H04R 1/025 381/74 |
| 2013/0101127 | A1 * | 4/2013 | Buchmann | H04R 29/005 381/58 |
| 2014/0072137 | A1 * | 3/2014 | Nelson | H04R 1/1041 381/74 |

FOREIGN PATENT DOCUMENTS

| | | |
|---|---|---|
| KR | 10-2004-0017111 A | 2/2004 |
| KR | 10-2007-0016868 A | 2/2007 |
| KR | 10-2010-0034229 A | 4/2010 |

* cited by examiner

*Primary Examiner* — Disler Paul
(74) *Attorney, Agent, or Firm* — Jefferson IP Law, LLP

(57) ABSTRACT

An unlocking apparatus and a method using an ear-micro headset in a terminal are provided. The unlocking apparatus and the method using an ear-micro headset in a terminal enable to unlock the terminal and switch to a speech recognition mode using the ear-micro headset placed into the terminal. The apparatus including a memory configured to store at least one password value for unlocking the terminal, and to switch to a speech recognition mode by using combinations of inputs of at least one button equipped in the ear-micro headset, and a controller coupled to the memory configured to unlock the terminal based on the combinations of inputs of the at least one button equipped in the ear-micro headset if the terminal is locked with the ear-micro headset plugged therein.

32 Claims, 6 Drawing Sheets

UNLOCKING APPARATUS AND METHOD USING EAR-MICRO HEADSET IN TERMINAL

PRIORITY

This application claims the benefit under 35 U.S.C. §119 (a) of a Korean patent application filed on Nov. 14, 2012 in the Korean Intellectual Property Office, and assigned Serial No. 10-2012-0129130, the entire disclosure of which is hereby incorporated by reference.

BACKGROUND OF THE INVENTION

1. Field of the Invention

The present invention relates to an unlocking apparatus and method using an ear-micro headset in a terminal. More particularly, the present invention relates to an unlocking apparatus and method using an ear-micro headset in a terminal, which enables the terminal to be unlocked and switched to a speech recognition mode using the ear-micro headset placed into the terminal.

2. Description of the Related Art

One can often listen to music from a terminal with an ear-micro headset plugged therein.

As the terminal has become equipped with not only a music player function but also a speech recognition function, a user can conveniently activate the speech recognition function using the ear-micro headset plugged in the terminal while having the terminal in his/her pocket or a bag.

However, in a case where the terminal is locked for security reasons, the user has to get the terminal out of the pocket or bag and unlock the terminal to activate the speech recognition function using the ear-micro headset plugged in the terminal.

Therefore, a need exists for an apparatus and method which enables the user of the apparatus to unlock the terminal and switch to a speech recognition mode using the ear-micro headset, plugged in the terminal.

The above information is presented as background information only to assist with an understanding of the present disclosure. No determination has been made, and no assertion is made, as to whether any of the above might be applicable as prior art with regard to the present invention.

SUMMARY OF THE INVENTION

Aspects of the present invention are to address at least the above-mentioned problems and/or disadvantages and to provide at least the advantages described below. Accordingly, an aspect of the present invention is to provide an unlocking apparatus and method using an ear-micro headset in a terminal, which enables the terminal to be unlocked and switched to a speech recognition mode using the ear-micro headset, plugged in the terminal.

In accordance with an aspect of the present invention, an unlocking apparatus using an ear-micro headset in a terminal is provided. The apparatus includes a memory configured to store at least one password value for unlocking the terminal, and to switch to a speech recognition mode by using combinations of inputs of at least one button equipped in the ear-micro headset, and a controller coupled to the memory configured to unlock the terminal based on the combinations of inputs of the at least one button equipped in the ear-micro headset if the terminal is locked with the ear-micro headset plugged therein.

In accordance with another aspect of the present invention, an unlocking method using an ear-micro headset in a terminal is provided. The method includes plugging the ear-micro headset in the terminal, and unlocking the terminal based on a combination of inputs of at least one button equipped in the ear-micro headset if the terminal is locked with the ear-micro headset plugged therein.

In accordance with yet another aspect of the present invention, an apparatus disposed in a mobile terminal for unlocking the mobile terminal is provided. The apparatus includes a memory storing at least one password value configured to unlock the mobile terminal, and to switch the mobile terminal to a speech recognition mode according to an input value entered through a headset connected to the mobile terminal, and a controller coupled to the memory configured to unlock the mobile terminal when the input value entered through the headset matches the at least one password value stored in the memory of the mobile terminal.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following describing taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In exemplary embodiments of the present invention, a terminal refers to a portable terminal or a fixed terminal. The portable terminal is a mobile electronic device that is easily carried by humans, and may include video phones, portable headsets, smart phones, International Mobile Telecommunication-2000 (IM-2000) terminals, Wideband Code Division Multiple Access (WCDMA) terminals, Universal Mobile Telecommunication Service (UMTS) terminals, Personal Digital Assistants (PDAs), Portable Multimedia Players (PMPs), Digital Multimedia Broadcasting (DMB) terminals, E-Books, portable computers (e.g., laptops, tablet Personal Computers (PCs), etc.), or digital cameras. The fixed terminal may be a desktop PC.

In an exemplary embodiment of the present invention, the ear-micro headset includes 3 buttons and a plug with 4 terminals. However, any ear-micro headsets having any number of buttons and plug terminals that may output resistance values assigned to the buttons may also be employed in the exemplary embodiment of the present invention.

Figure 1:
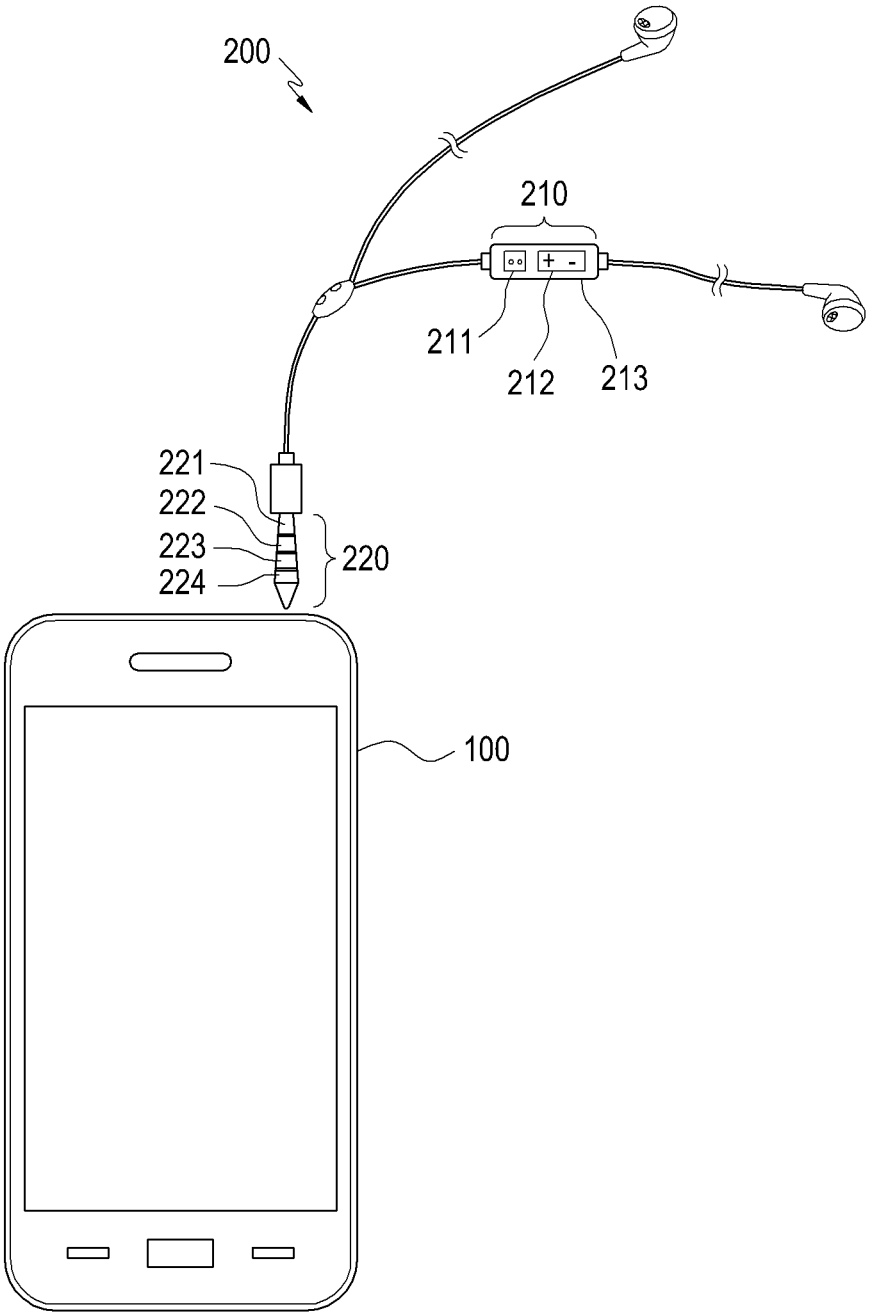
FIG. 1 illustrates a terminal with an ear-micro headset plugged therein, according to an exemplary embodiment of the present invention.

FIG. 1 illustrates the terminal with an ear-micro headset plugged therein, according to an exemplary embodiment of the present invention.

Referring to FIG. 1, the ear-micro headset 200 includes a button unit 210, a plug 220, and left and right earpiece speakers.

The button unit 210 includes a call/stop button 211, a volume up (+) button 212, and a volume down (−) button 213, and a micro headset (not shown). The buttons 211-213 are used to make/receive/stop a call in a calling mode and to play music in a music play mode. In an exemplary embodiment of the present invention, the buttons 211-213 may switch the terminal 100 with the ear-micro headset 200 plugged therein to a speech recognition mode, or unlock the terminal and then switch the terminal to the speech recognition mode. The buttons 211 to 213 are each assigned a resistance value.

The plug 220 placed in an ear-jack of the terminal 100 connects the ear-micro headset 200 to the terminal 100.

The plug 220 includes a micro headset terminal 221, a ground terminal 222, a right earpiece speaker terminal 223, and a left earpiece speaker terminal 224. When the plug 220 is inserted into the ear jack of the terminal 100, not only voice input through the ear-micro headset 200 but also the resistance value assigned to a selected (or pressed) one of buttons 211-213 of the button unit 210 are sent to the terminal 100.

When the ear-micro headset 200 is inserted into the terminal 100, the terminal 100 is unlocked and switched to a speech recognition mode based on a combination of inputs of the buttons 211 to 213.

Configurations of the terminal 100 will now be described in detail with reference to FIG. 2.

Figure 2:
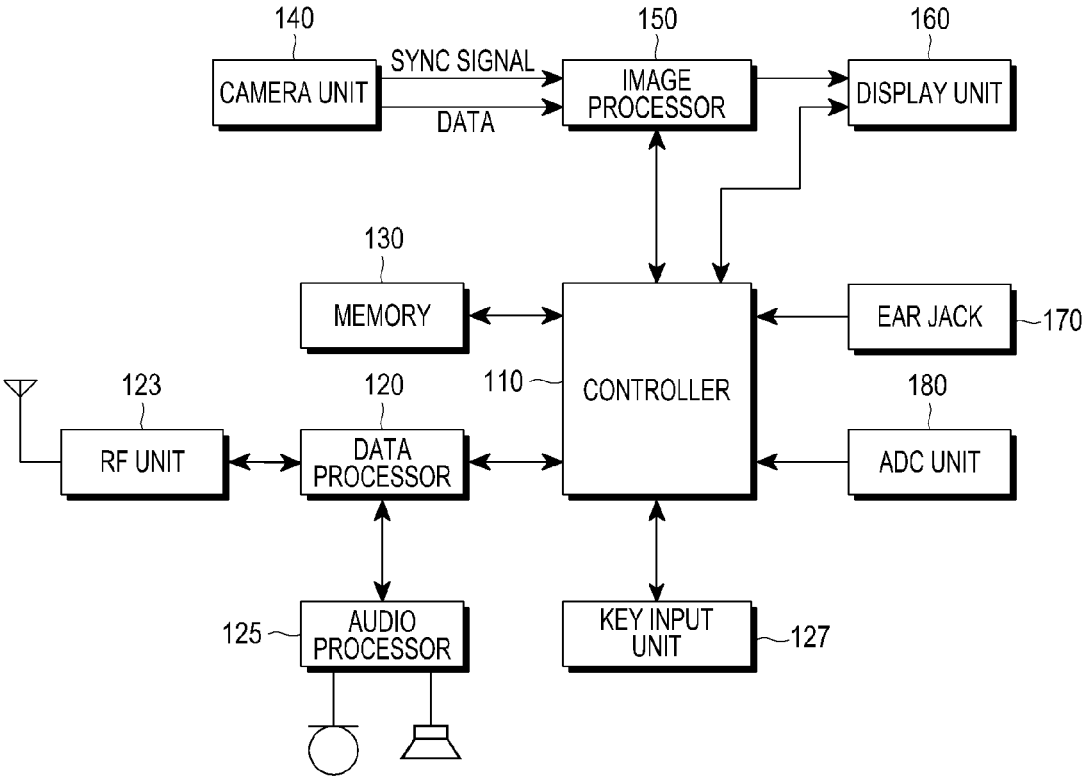
FIG. 2 is a block diagram of the terminal, according to an exemplary embodiment of the present invention.

FIG. 2 is a block diagram of the terminal, according to an exemplary embodiment of the present invention.

Referring to FIG. 2, a Radio Frequency (RF) unit 123 performs a wireless communication function of the terminal. The RF unit 123 includes an RF transmitter for up converting a frequency of a transmit signal and amplifying the transmit signal and an RF receiver for low-noise amplifying a received signal and down converting the frequency of the received signal. A data processor 120 includes a transmitter for encoding and modulating the transmit signal, and a receiver for demodulating and decoding the received signal. The data processor 120 may be composed of a modem and a codec. The codec includes a data codec for processing e.g., packet data and an audio codec for processing an audio signal, such as voice. An audio processor 125 plays a received audio signal output from the audio codec of the data processor 120, or transmits an audio signal generated by the micro headset to the audio codec of the data processor 120.

A key input unit 127 includes alphanumeric keys with which to input number and character information, and function keys with which to set various functions.

A memory 130 may consist of program and data memories. The program memory may store programs for controlling general operations of the terminal, and programs for controlling to unlock the terminal and switch the terminal to the speech recognition mode based on a combination of inputs of buttons of the ear-micro headset 200 plugged in the terminal 100, according to an exemplary embodiment of the present invention. Also, the data memory temporarily stores data generated in the course of running the programs.

The memory 130 also stores at least one password value for unlocking the terminal 100 and switching to the speech recognition mode based on combinations of inputs of buttons 211 to 213 equipped in the ear-micro headset 200 when the ear-micro headset 200 is plugged in the terminal 100. In other words, the memory 130 stores at least one password value for unlocking the terminal 100 and switching to the speech recognition mode based on combinations of received resistance values assigned to buttons 211 to 213 when the buttons 211 to 213 equipped in the ear-micro headset 200 are pressed.

The memory 130 may store one password value with which to unlock the terminal 100 and switch to the speech recognition mode based on combinations of inputs of buttons 211 to 213 equipped in the ear-micro headset 200 when the ear-micro headset is plugged in the terminal 100.

Alternately, the memory 130 may store a plurality of password values for immediately switching to a speech recognition mode (e.g., a speech recognition mode for calling, or a speech recognition mode for music play) to perform a function corresponding to the particular button based on combinations of an input of a particular button firstly pressed for more than a predetermined period of time and subsequent inputs of buttons 211 to 213, when the ear-micro headset 200 is plugged in the terminal 100.

Or alternatively, the memory 130 may store a plurality of password values for immediately switching to a speech recognition mode (e.g., a speech recognition mode for calling, or a speech recognition mode for music play) to perform a function corresponding to a type of combination of buttons 211 to 213 equipped in the ear-micro headset 200 based on types of combinations, when the ear-micro headset 200 is plugged in the terminal 100.

The controller 110 controls the general operations of the terminal 100.

The controller 110 stores a combination of at least one resistance value assigned to at least one button pressed by the user among buttons 211 to 213 of the ear-micro headset 200 plugged in the terminal 100 as a password value for unlocking the terminal 100 and switching to the speech recognition mode in a password setting mode for unlocking the terminal 100 using the ear-micro headset 200.

The controller 110 may store a plurality of password values for unlocking the terminal 100 and immediately switching to the speech recognition mode (e.g., the speech recognition mode for calling or the speech recognition mode for music play) based on combinations of a resistance value of a particular button firstly pressed by the user among buttons 211 to 213 of the ear-micro headset 200 plugged in the terminal 100 and resistance values assigned to at least one button among buttons 211 to 213 later pressed, in the password setting mode for unlocking the terminal 100 using the ear-micro headset 200.

The controller 110 may store a plurality of password values for unlocking the terminal 100 and immediately switching to the speech recognition mode (e.g., the speech recognition mode for calling or the speech recognition mode for music play) according to a type of combination of at least one resistance value assigned to at least one button selected by the user among buttons 211 to 213 of the ear-micro headset 200 plugged in the terminal 100, in the password setting mode for unlocking the terminal 100 using the ear-micro headset 200.

The controller 110 unlocks the terminal 100 and switches to the speech recognition mode according to a combination of inputs of the buttons 211 to 213 when the terminal is locked with the ear-micro headset 200 plugged therein.

The controller 110, upon reception of at least one resistance value assigned to at least one button selected from among buttons 211 to 213 of the ear-micro headset 200, combines the received at least one resistance value and compares the combined resistance value with a password value stored in the memory 130, when the terminal is locked with the ear-micro headset plugged therein. If the combined resistance value matches the password value stored in the memory 130, the controller 110 unlocks the terminal and switches to the speech recognition mode.

Furthermore, the controller 110 switches to the speech recognition mode if a button among those 211 to 213 of the ear-micro headset 200 for unlocking the terminal 100 has been pressed for more than a predetermined period of time, when the terminal 100 is unlocked with the ear-micro headset 200 plugged therein.

The controller 110 determines that the terminal 100 is to be unlocked if a resistance value assigned to a button among buttons 211 to 213 of the ear-micro headset 200 for unlocking the terminal 100 has been pressed for more than a predetermined period of time, and outputs a voice command to request that a password be entered for unlocking the terminal 100, when the terminal 100 is locked with the ear-micro headset 200 plugged therein. The controller 110 then, upon reception of at least one resistance value assigned to at least one button from the ear-micro headset 200, combines the at least one resistance value and compares the combined resistance value with a password value stored in the memory 130. If the comparison shows that the combined resistance value matches the password value, the controller 110 unlocks the terminal 100 and switches to the speech recognition mode.

Furthermore, the controller 110 determines that the terminal 100 is to be unlocked if a resistance value assigned to a particular button among buttons 211 to 213 of the ear-micro headset 200 has been pressed for more than a predetermined period of time, determines a type of the speech recognition mode based on the resistance value assigned to the particular button, and outputs a voice command to request that a password be entered for unlocking the terminal 100, when the terminal 100 is locked with the ear-micro headset 200 plugged therein. The controller 110 then, upon reception of at least one resistance value assigned to at least one button from the ear-micro headset 200, combines the at least one resistance value and compares the combined resistance value with a password value stored in the memory 130. If the comparison shows that the combined resistance value matches the password value, the controller 110 unlocks the terminal 100 and immediately switches to a speech recognition mode for performing a function corresponding to the particular button. For example, if the function corresponding to the particular button is calling, the controller 110 switches to the speech recognition mode for calling; or otherwise if it is playing music, the controller 10 switches to the speech recognition mode for music play.

Alternatively, the controller 110 directly switches to the speech recognition mode for performing the function corresponding to the particular button if the resistance value assigned to the particular button among buttons 211 to 213 has been pressed for more than a predetermined period of time, when the terminal 100 is unlocked with the ear-micro headset 200 plugged therein.

The controller 110 determines that the terminal 100 is to be unlocked if a resistance value assigned to a button among buttons 211 to 213 of the ear-micro headset 200 for unlocking the terminal 100 has been pressed for more than a predetermined period of time, and outputs a voice command to request that a password be entered for unlocking the terminal 100, when the terminal 100 is locked with the ear-micro headset 200 plugged therein. The controller 110 then, upon reception of at least one resistance value assigned to at least one button from the ear-micro headset 200, combines the received at least one resistance value and searches for a password value that corresponds to the combined resistance value from among the plurality of password values stored in the memory 130. Then the controller 110 directly switches to the speech recognition mode for performing a function corresponding to the searched password value. For example, if the function corresponding to the searched password value is calling, the controller 110 switches to the speech recognition mode for calling, otherwise if the function is for playing music, the controller 110 switches to the speech recognition mode for music play.

An ear-micro headset equipped with a single button may also be employed in another exemplary embodiment of the present invention. In this case, each time the single button is pressed while the ear-micro headset is plugged in the terminal 100, the controller 110 may unlock the terminal and switch to the speech recognition mode using an interval of reception of the resistance value assigned to the single button. The interval of reception of the resistance value assigned to the single button may be set by the user in the password setting mode for unlocking with the ear-micro headset.

When the plug 220 of the ear-micro headset 200 is inserted into an ear jack 170, the ear jack 170 connects the terminal 100 to the ear-micro headset 200.

When the plug 220 of the ear-micro headset 200 is inserted into the ear jack 170, an Analog-to-Digital Converter (ADC) 180, upon reception of a resistance value assigned to a button selected from among buttons 211 to 213 of the ear-micro headset 200 through a micro headset terminal 221 of the plug 220, converts the received analog resistance value to a digital resistance value and provides the digital resistance value to the controller 110.

A camera unit 140 capturing an image includes a camera sensor for converting the captured image to analog electric signals, and a signal processor for converting analog electric signals to digital image data. The camera sensor is assumed to be a Charge-Coupled Device (CCD) or a Complementary Metal-Oxide Semiconductor (CMOS), and the signal processor may be implemented with a Digital Signal Processor (DSP). The camera sensor and the signal processor may be integrated together, or may be implemented separately.

An image processor 150 performs Image Signal Processing (ISP) for displaying image data output by the camera unit 140, and the ISP performs gamma correction, interpolation, spatial change, image effect, image scale, Automatic White Balance (AWB), Automatic Exposure (AE), Automatic Focus (AF), and the like. The image processor 150 processes the image data in the frame unit and outputs image frame data to a size and characteristics of a display unit 160. The image processor 150 also includes an image codec for compressing the image frame data to be displayed in the display unit 160 in a predetermined compression method or for decompressing the pressed frame image data. The image codec may be a Joint Photographic Experts Group (JPEG) codec, a Moving Picture Experts Group (MPEG) 4 codec, or the like. The image processor 150 is assumed herein to have an On Screen Display (OSD) function, and may output OSD data to a displayed screen size under control of the controller 110.

The display unit 160 displays the image frame data output by the image processor 150 onto a screen and displays user data output by the controller 110. The display unit 160 may use a Liquid Crystal Display (LCD), in which case the display unit 160 may include an LCD controller, a memory for storing the image frame data, and an LCD display device. If implemented as a touchscreen, the LCD of the display unit 160 may serve as an input unit, in which case keys like the key input unit 127 may be displayed in the display unit 160.

If the display unit 160 is implemented as the touchscreen, the display unit 160 may be comprised of TouchScreen Panels (TSPs) having a plurality of sensor panels. The sensor panels may include capacitive sensor panels that may recognize a user's touch and electromagnetic sensor panels that may detect finer touches, e.g., a touch which is made by a touch pen.

Operations of unlocking the terminal 100 using the ear-micro headset 200 will be described in detail with reference to FIGS. 3 to 5.

Figure 3:
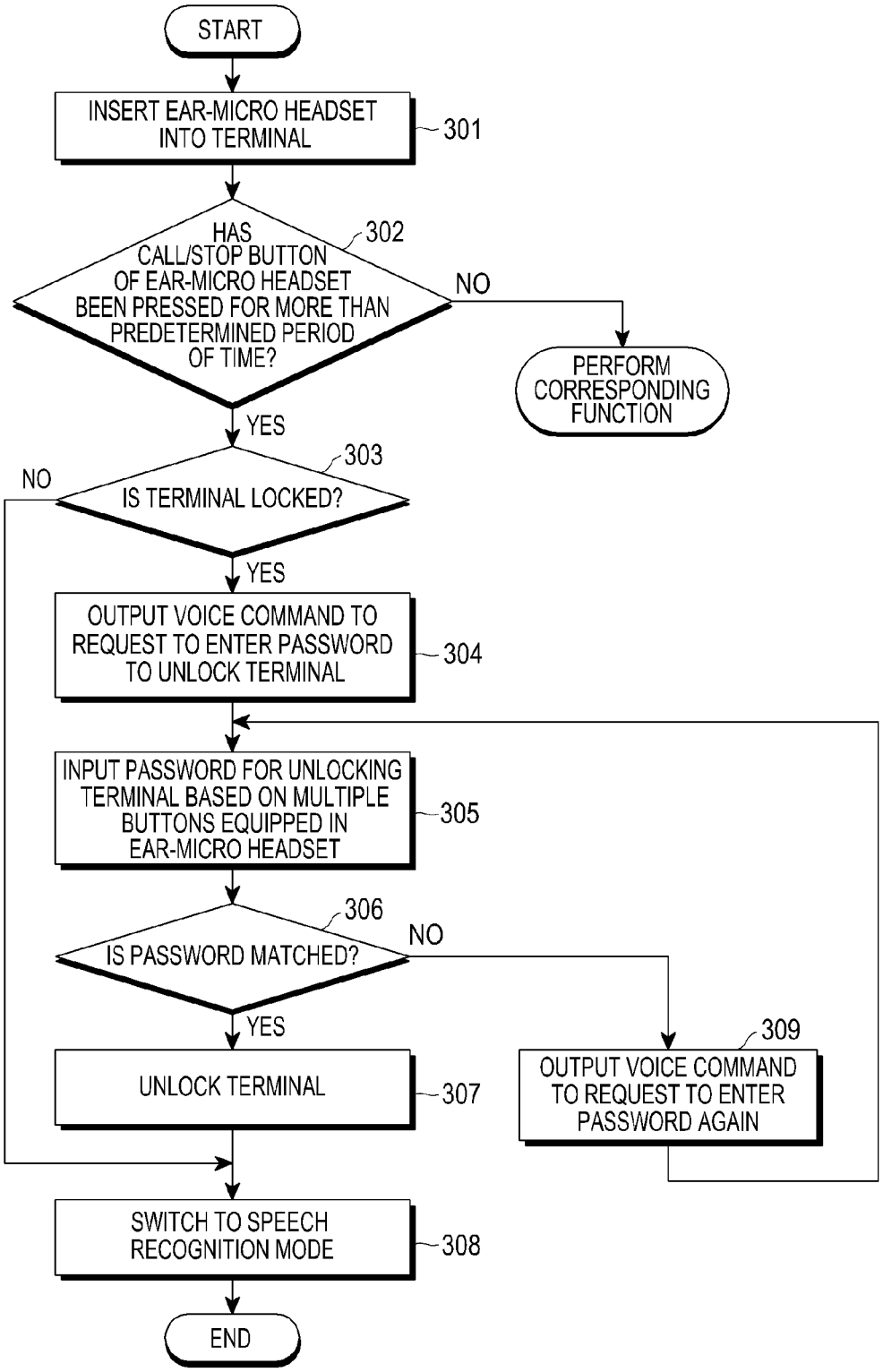
FIG. 3 is a flowchart of an unlocking process using an ear-micro headset in a terminal, according to an exemplary embodiment of the present invention.

FIG. 3 is a flowchart of an unlocking process using an ear-micro headset in a terminal, according to an exemplary embodiment of the present invention.

The exemplary embodiment of the present invention will be described in conjunction with FIGS. 1 and 2.

Referring to FIG. 3, the unlocking process begins with the plug 220 of the ear-micro headset 200 being placed in the ear jack 170 of the terminal 100 in step 301. If a button for unlocking the terminal, e.g., a call/stop button 211 among buttons 211 to 213 equipped in the ear-micro headset 200 has been pressed by a user for more than a predetermined period of time in step 302, a resistance value corresponding to the call/stop button 211 is sent to the ADC unit 180 through the micro headset terminal 221 of the plug 220 of the ear-micro headset 200. The ADC unit 180 converts the resistance value assigned to the call/stop button 211 to a digital resistance value and provides the digital resistance value to the controller 110.

In this regard, upon reception for more than the predetermined period of time, of the (digital) resistance value 300 k corresponding to the call/stop button 211 set up as the button for unlocking the terminal 100 from the ADC unit 180, the controller 110 determines in step 302 that the call/stop button 211 for unlocking the terminal 100 has been pressed and determines whether the terminal is locked in step 303.

If determining that the terminal is unlocked in step 303, the controller 110 continues with step 308 to immediately switch to the speech recognition mode.

However, if determining that the terminal 100 is locked in step 303, the controller 110 proceeds to step 304 to output a voice command to request that a password be entered to unlock the terminal.

If at least one of the buttons 211 to 213 equipped in the ear-micro headset 200 is pressed by the user in step 305 after the voice command is output, at least one resistance value corresponding to the at least one button is sequentially sent to the ADC unit 180. The ADC unit 180 converts the sequentially received at least one resistance value to at least one digital resistance value and provides the digital resistance value to the controller 110.

The controller 110 combines the at least one digital resistance value and determines if the combined resistance value matches a password value stored beforehand in the memory 130.

If determining that the combined resistance value matches the password value in step 306, the controller 110 unlocks the terminal 100 in step 307 and switches to the speech recognition mode in step 308.

For example, in a case where a combined resistance value resulting from sequential combination of a first resistance value 300 k, a second resistance value 300 k, and a third resistance value 100 k is set up as a password value for unlocking the terminal 100 and switching to the speech recognition mode, if resistance values assigned to those buttons, the first resistance value 300 k, the second resistance value 300 k, and the third resistance value 100 k are sequentially received as the user sequentially presses the call/stop button 211, the call/stop button 211 again, and the volume up (+) button 212, the controller 110 unlocks the terminal 100 in step 307 and switches to the speech recognition mode in step 308.

In the speech recognition mode, the controller 110 performs a function corresponding to a voice command of the user input through the micro headset of the ear-micro headset 200.

Otherwise, if determining that the combined resistance value does not match the password value stored beforehand in the memory 130 in step 306, the controller 110 proceeds to step 309 to request that the password be entered again due to the mismatch of the password for unlocking. If the password is incorrectly input more than a predetermined number of times, the controller 110 prohibits the terminal 100 from being used for a certain period of time or sends a message including location information to a phone number of a contact stored in the terminal 100 indicating that an error occurred accessing the terminal 100 and/or reporting that the terminal may have been lost or stolen.

Figure 4A:
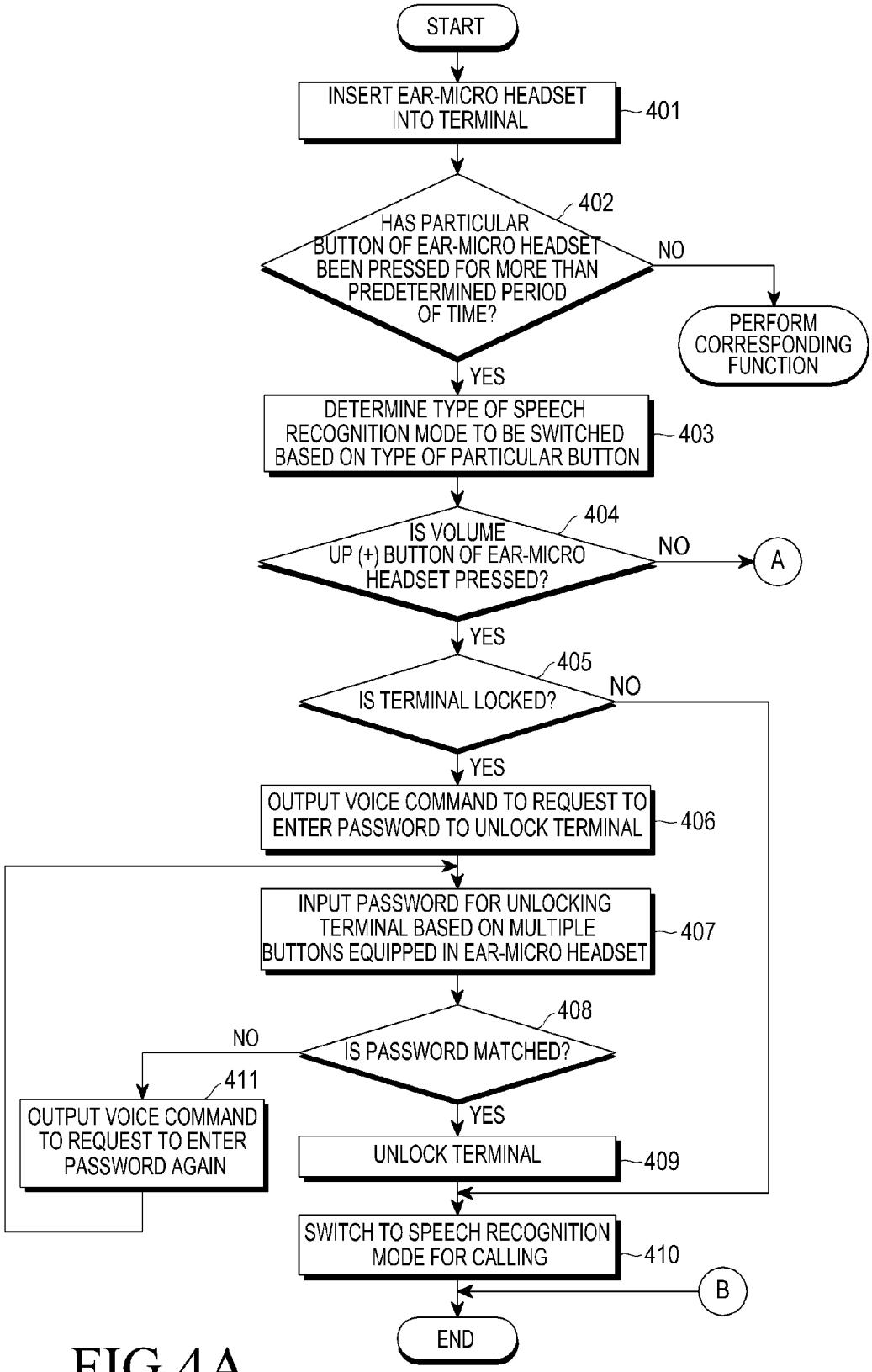
FIGS. 4A and 4B are flowcharts of an unlocking process using an ear-micro headset in a terminal, according to another exemplary embodiment of the present invention.
Figure 4B:
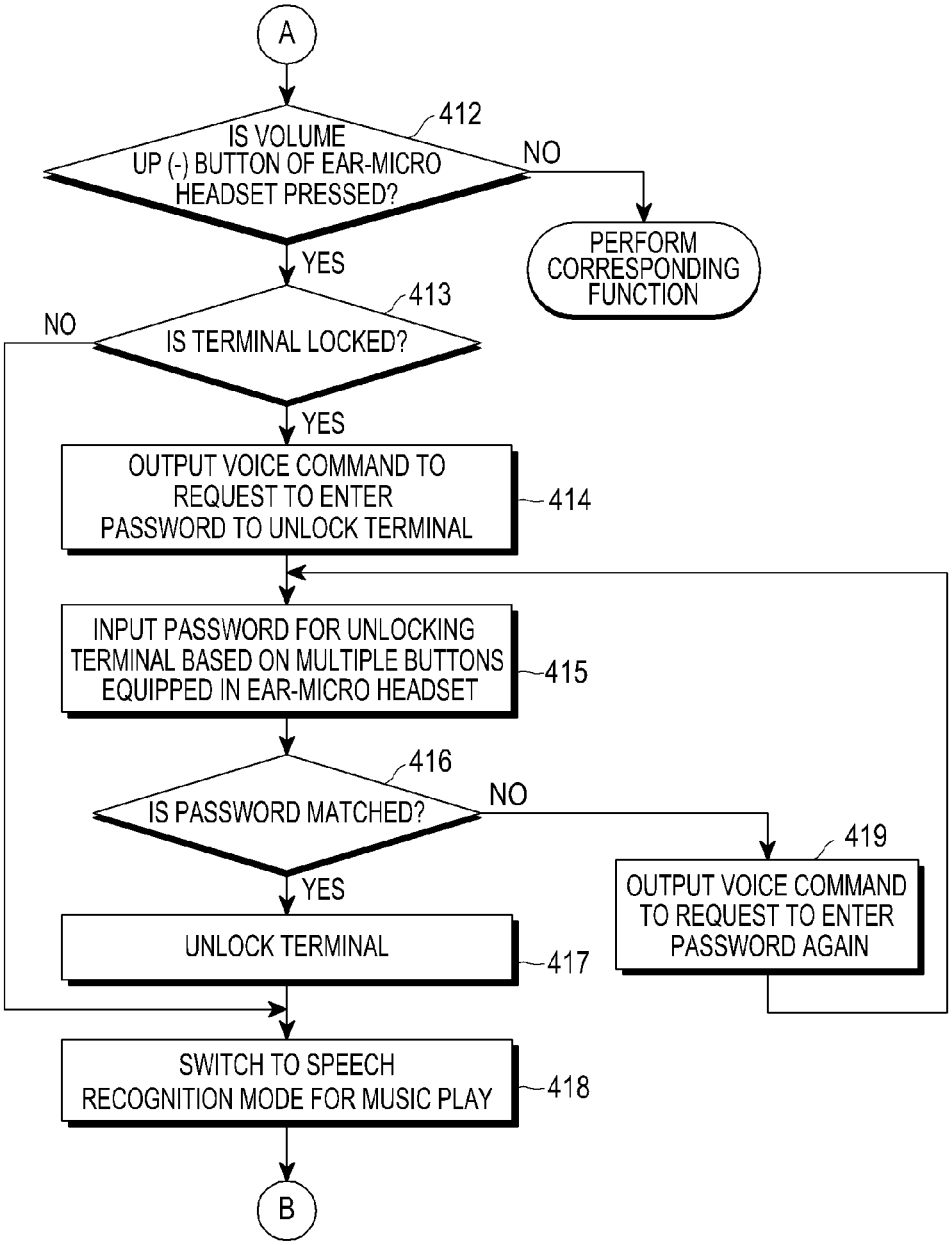

FIGS. 4A and 4B are flowcharts of an unlocking process using an ear-micro headset in a terminal, according to another exemplary embodiment of the present invention.

The exemplary embodiment of the present invention will be described with reference to FIGS. 1 and 2.

Referring to FIGS. 4A and 4B, the unlocking process begins with the plug 220 of the ear-micro headset 200 being placed in the ear jack 170 of the terminal 100 in step 401. If a particular button among buttons 211 to 213 equipped in the ear-micro headset 200 has been pressed by a user for more than a predetermined period of time in step 402, a resistance value assigned to the particular button is sent to the ADC unit 180 through the micro headset terminal 221 of the plug 220 of the ear-micro headset 200. The ADC unit 180 converts the resistance value corresponding to the particular button to a digital resistance value and provides the digital resistance value to the controller 110.

If determining that the digital resistance value has been received from the ADC unit 180 for more than the predetermined period of time in step 402, the controller 110 determines that the particular button corresponding to a type of the speech recognition mode has been pressed and then identifies the type of the speech recognition mode based on the received digital resistance value, in step 403.

If determining that the received digital resistance value is 100 k assigned to the volume up (+) button 212 of the ear-micro headset 200 in step 404, the controller 110 determines that the speech recognition mode for calling has been requested.

Then, the controller 110 determines whether the terminal is locked.

If determining that the terminal is unlocked in step 405, the controller 110 continues with step 410 to directly switch to the speech recognition mode for calling.

However, if determining that the terminal 100 is locked in step 405, the controller 110 proceeds to step 406 to output a voice command to request that a password be entered to unlock the terminal.

If at least one of the buttons 211 to 213 is pressed by the user in step 407 after the voice command is output, at least one resistance value assigned to the at least one button is sequentially sent to the ADC unit 180. The ADC unit 180 converts the sequentially received at least one resistance value to at least one digital resistance value and provides the digital resistance value to the controller 110.

The controller 110 combines the at least one digital resistance value and determines if the combined resistance value matches a password value stored beforehand in the memory 130.

If determining that the combined resistance value matches the password value in step 408, the controller 110 unlocks the terminal 100 in step 409 and switches to the speech recognition mode for calling in step 410.

In the speech recognition mode for calling, the controller 110 performs a function for calling corresponding to a voice command of the user input through the micro headset of the ear-micro headset 200. In the speech recognition mode for calling, simply telling a "receiver's name" or his "phone number" as the voice command may perform calling to the receiver or the phone number.

Otherwise, if determining that the combined resistance value does not match the password value stored beforehand in the memory 130 in step 408, the controller 110 proceeds to step 411 to request that the password be entered again due to the mismatch of the password for unlocking. If the password is incorrectly input more than a predetermined number of times, the controller 110 prohibits the terminal 100 from being used for a certain period of time or sends a message including location information to a phone number of a contact stored in the terminal 100 indicating an error occurred accessing the terminal 100 and/or reporting that the terminal 100 may have been lost or stolen.

As a result of determining the type of the speech recognition based on the resistance value received from the ADC unit 180 in step 403, if determining that the resistance value received from the ADC unit 180 is 200 k assigned to the volume down (−) button 213 of the ear-micro headset 200, in step 412, the controller 110 determines that switching to the speech recognition mode for music play has been requested.

Then, the controller 110 determines whether the terminal is locked.

If determining that the terminal is unlocked in step 413, the controller 110 continues with step 418 to directly switch to the speech recognition mode for music play.

However, if determining that the terminal 100 is locked in step 413, the controller 110 proceeds to step 414 to output a voice command to request that a password be entered to unlock the terminal.

If at least one of the buttons 211 to 213 equipped in the ear-micro headset 200 is pressed by the user in step 415 after the voice command is output, at least one resistance value corresponding to the at least one button is sequentially sent to the ADC unit 180. The ADC unit 180 converts the sequentially received at least one resistance value to at least one digital resistance value and provides the digital resistance value to the controller 110.

The controller 110 combines the at least one digital resistance value and determines if the combined resistance value matches a password value stored beforehand in the memory 130.

If determining that the combined resistance value matches the password value in step 416, the controller 110 unlocks the terminal 100 in step 417 and switches to the speech recognition mode for music play in step 418.

In the speech recognition mode for music play, the controller 110 performs a function for playing music corresponding to a voice command of the user input through the micro headset of the ear-micro headset 200. In the speech recognition mode for music play, simply telling a "title of the music" as the voice command may play the corresponding music.

Otherwise, if determining that the combined resistance value does not match the password value stored in the memory 130 in step 416, the controller 110 proceeds to step 419 to request that the password be entered again due to the mismatch of the password for unlocking. If the password is incorrectly input more than a predetermined number of times, the controller 110 prohibits the terminal 100 from being used for a certain period of time or sends a message including location information to a phone number of a contact stored in the terminal 100 indicating an error occurred accessing the terminal 100 and reporting that the terminal 100 may have been lost or stolen.

Figure 5:
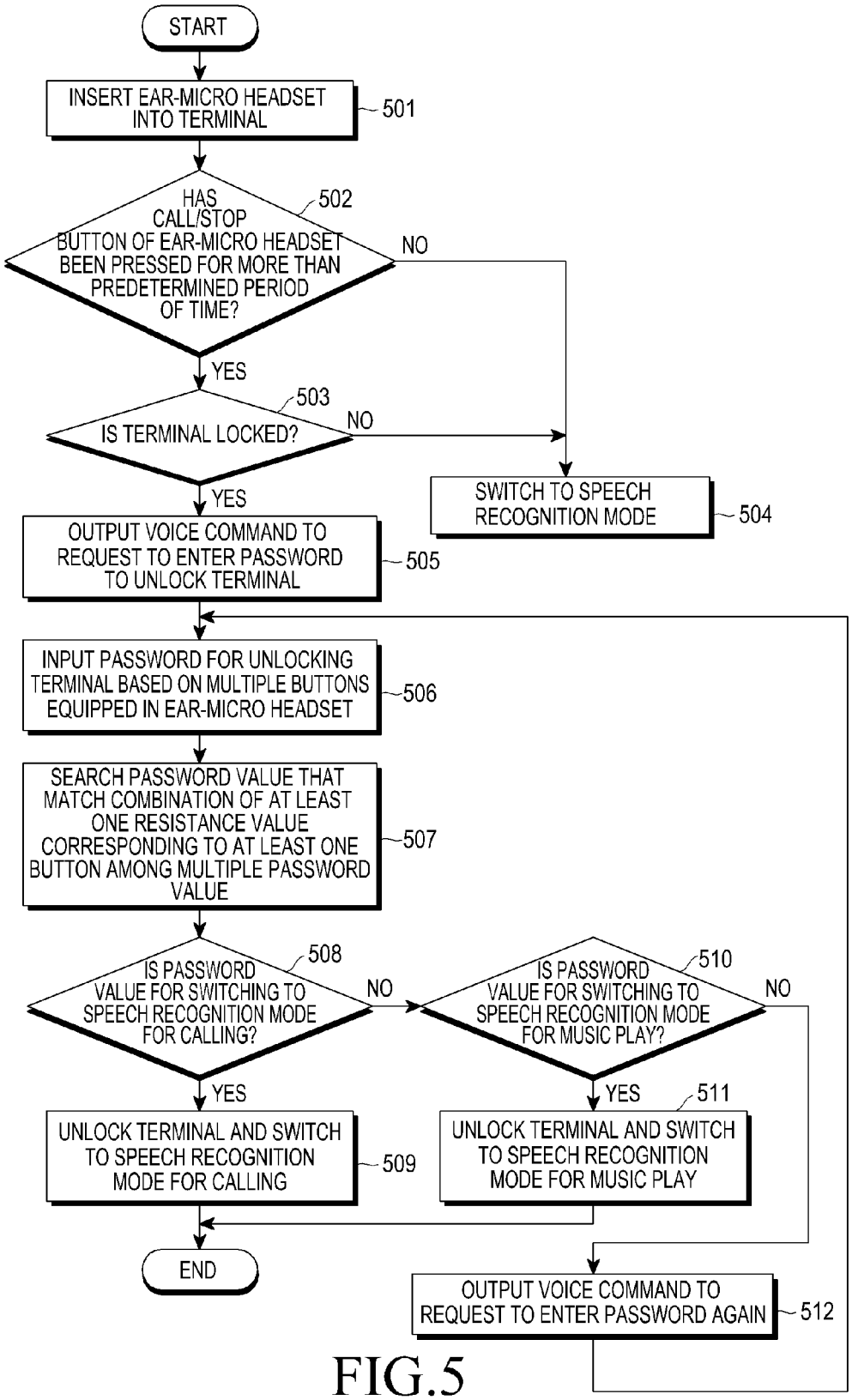
FIG. 5 is a flowchart of an unlocking process using an ear-micro headset in a terminal, according to yet another exemplary embodiment of the present invention.

FIG. 5 is a flowchart of an unlocking process using an ear-micro headset in a terminal, according to yet another exemplary embodiment of the present invention.

The exemplary embodiment of the present invention will be described with reference to FIGS. 1 and 2.

Referring to FIG. 5, the unlocking process begins with the plug 220 of the ear-micro headset 200 being placed in the ear jack 170 of the terminal 100 in step 501. If a button for unlocking the terminal, e.g., a call/stop button 211 among buttons 211 to 213 equipped in the ear-micro headset 200 has been pressed by a user for more than a predetermined period of time in step 502, a resistance value corresponding to the call/stop button 211 is sent to the ADC unit 180 through the micro headset terminal 221 of the plug 220 of the ear-micro headset 200 (not shown). The ADC unit 180 converts the resistance value assigned to the call/stop button 211 to a digital resistance value and provides the digital resistance value to the controller 110.

In this regard, upon reception for more than the predetermined period of time, of the resistance value 300 k corresponding to the call/stop button 211 set up as the button for unlocking the terminal 100 from the ADC unit 180, the controller 110 determines in step 502 that the call/stop button 211 for unlocking the terminal 100 has been pressed and determines whether the terminal is locked, in step 503.

If determining that the terminal is unlocked in step 503, the controller 110 continues with step 504 to directly switch to the speech recognition mode. In the speech recognition mode, the controller 110 performs a function corresponding to a voice command of the user input through the micro headset of the ear-micro headset 200.

However, if determining that the terminal 100 is locked in step 503, the controller 110 proceeds to step 505 to output a voice command to request that a password be entered to unlock the terminal.

If at least one of the buttons 211 to 213 is pressed by the user in step 506 after the voice command is output, at least one resistance value corresponding to the at least one button is sequentially sent to the ADC unit 180. The ADC unit 180 converts the sequentially received at least one resistance value to at least one digital resistance value and provides the digital resistance value to the controller 110.

If determining that the password value searched in step 507 is one for switching to the speech recognition mode for calling in step 508, the controller 110 unlocks the terminal and switches to the speech recognition mode for calling, in step 509.

Or, if determining that the password value searched in step 507 is one for switching to the speech recognition mode for music play in step 510, the controller 110 unlocks the terminal and switches to the speech recognition mode for music play, in step 511.

For example, in a case, among a plurality of password values stored in advance in the memory 130, a combined resistance value resulting from a sequential combination of a first resistance value 300 k, a second resistance value 100 k, and a third resistance value 200 k is set to be a password value for unlocking the terminal 100 and switching to the speech recognition mode for calling and a combined resistance value resulting from a sequential combination of a first resistance value 100 k, a second resistance value 300 k, and a third resistance value 200 k is set to be a password value for unlocking the terminal and switching to the speech recognition mode for music play, if the user sequentially presses the call/stop button 211, the volume up (+) button 212, and the volume down (–) button 213 and accordingly the first and second and third resistance values 300 K, 100 K, and 200 K, respectively, are sequentially received, the controller 110 unlocks the terminal 100 and switches to the speech recognition mode for calling, in step 509.

In the speech recognition mode for calling, the controller 110 performs a function for calling corresponding to a voice command of the user input through the micro headset of the ear-micro headset 200. In the speech recognition mode for calling, simply telling a "receiver's name" or his "phone number" as the voice command may perform calling to the receiver or the phone number.

If the user sequentially presses the volume up (+) button 212, the call/stop button 211, and the volume down (–) button 213 and accordingly the first and second and third resistance values 100 K, 300 K, and 200 K, respectively, are sequentially received, the controller 110 unlocks the terminal and switches to the speech recognition mode for music play, in step 511.

In the speech recognition mode for music play, simply telling a "title of the music" as the voice command may play the corresponding music.

Otherwise, if determining that the combined resistance value does not match any of the password values stored in the memory 130, the controller 110 proceeds to step 512 to request that the password be entered again due to the mismatch of the password for unlocking. If the password is incorrectly input more than a predetermined number of times, the controller 110 prohibits the terminal 100 from being used for a certain period of time or sends a message including location information to a phone number of a contact stored in the terminal 100 indicating an error occurred accessing the terminal 100 and reporting that the terminal 100 may have been lost and/or stolen.

The technique described herein has an advantage of unlocking the terminal without direct manipulation of the terminal and switching to the speech recognition mode safely and conveniently using the ear-micro headset.

The unlocking apparatus and method using the ear-micro headset in the terminal may be embodied as computer-readable codes on a computer-readable recording medium.

The computer-readable recording medium is any data storage device that can store data which can be thereafter read by a computer system. Examples of the computer readable recording medium include Read-Only Memory (ROM), Random-Access Memory (RAM), Compact Disc (CD)-ROMs, magnetic tapes, floppy disks, optical data storage devices, etc. The computer readable recording medium can also be distributed over network coupled computer systems so that the computer readable code is stored and executed in a distributed fashion.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A terminal comprising:

a non-transitory memory configured to:

store at least one password value for unlocking the terminal, and switch to a speech recognition mode by using inputs of at least one button equipped in the ear-micro headset; and a controller electrically connected to the non-transitory memory configured to:

output a voice command to request entering a password for unlocking the terminal if the terminal is locked with the ear-micro headset plugged therein, unlock the terminal based on the inputs of the at least one button equipped in the ear-micro headset as the password after the voice command is output, and switch to a speech recognition mode corresponding to input of a button among a plurality of speech recognition modes based on the input of the button equipped in the ear-micro headset if the terminal is unlocked with the ear-micro headset plugged therein.

2. The terminal of claim 1, wherein the unlocking of the terminal includes switching to the speech recognition mode.

3. The terminal of claim 1, wherein the unlocking of the terminal is performed when a button for unlocking the terminal among the at least one button equipped in the ear-micro headset has been pressed for more than a predetermined period of time.

4. The terminal of claim 1, further comprising:

an analog to digital (ADC) unit configured to:

convert a resistance value assigned to a button pressed among the at least one button equipped in the ear-micro headset to a digital resistance value, and provide the digital resistance value to the controller.

5. The terminal of claim 1, wherein the controller is further configured to:

upon reception of at least one resistance value assigned to the at least one button equipped in the ear-micro headset, compare the received at least one resistance value with a password value stored in the non-transitory memory, and if the received at least one resistance value matches the password value stored in the non-transitory memory, unlock the terminal.

6. The terminal of claim 1, wherein the controller is further configured to, if the ear-micro headset is equipped with a single button and each time the single button is pressed, unlock the terminal according to intervals of reception of a resistance value assigned to the single button.

7. The terminal of claim 1, wherein the controller is further configured to, in a password setting mode for unlocking the terminal using the ear-micro headset, store at least one resistance value assigned to the at least one button equipped in the ear-micro headset in the non-transitory memory as a password value to unlock the terminal.

8. The terminal of claim 1, wherein the controller is further configured to, if a button among the at least one button equipped in the ear-micro headset for unlocking the terminal has been pressed for more than a predetermined period of time while the terminal is unlocked with the ear-micro headset plugged therein, switch to a speech recognition mode.

9. The terminal of claim 1, wherein the controller is further configured to:

if a resistance value assigned to a button among the at least one button equipped in the ear-micro headset for unlocking the terminal has been received for more than a predetermined period of time while the terminal is locked with the ear-micro headset plugged therein, output the voice command to request entering the password for unlocking the terminal, if at least one resistance value assigned to the at least one button equipped in the ear-micro headset is received, compare the received at least one resistance value with a password value stored in the non-transitory memory, and if the received at least one resistance value matches the password value stored in the non-transitory memory, unlock the terminal.

10. The terminal of claim 9, wherein the controller is further configured to, if a button among the at least one button equipped in the ear-micro headset for unlocking the terminal has been pressed for more than a predetermined period of time while the terminal is unlocked, switch the terminal to a speech recognition mode.

11. The terminal of claim 1, wherein the controller is further configured to:

if a resistance value assigned to a particular button among the at least one button equipped in the ear-micro headset has been received for more than a predetermined period of time while the terminal is locked with the ear-micro headset plugged therein, determine a type of the speech recognition mode based on the resistance value assigned to the particular button and output a voice command to request entering a password for unlocking the terminal, if at least one resistance value assigned to the at least one button equipped in the ear-micro headset is received, compare the received at least one resistance value with a password value stored in the non-transitory memory, and if the received at least one resistance value matches the password value stored in the non-transitory memory, unlock the terminal and switch to a speech recognition mode for performing a function corresponding to the particular button.

12. The terminal of claim 11, wherein the controller is further configured to, if the particular button has been pressed for more than a predetermined period of time while the terminal is unlocked, switch to a speech recognition mode for performing a function corresponding to the particular button.

13. The terminal of claim 11, wherein the controller is further configured to:

if the function corresponding to the particular button is calling, switch to a speech recognition mode for calling, and if the function corresponding to the particular button is playing music, switch to a speech recognition mode for playing music.

14. The terminal of claim 1, wherein the controller is further configured to:

if a resistance value assigned to a button for unlocking the terminal has been received for more than a predetermined period of time while the terminal is locked with the ear-micro headset plugged therein, output a voice command to request entering a password for unlocking the terminal, if at least one resistance value assigned to the at least one button equipped in the ear-micro headset is received, search for at least one password value among password values stored in the non-transitory memory that correspond to the received at least one resistance value, and if the at least one password value matches the received at least one resistance value, unlock the terminal and switches to a speech recognition mode for performing a function corresponding to the searched password value.

15. The terminal of claim 14, wherein the controller is further configured to, if the button for unlocking the terminal has been pressed for more than a predetermined period of time while the terminal is unlocked, switch to the speech recognition mode.

16. The terminal of claim 14, wherein the controller is further configured to, if the function corresponding to the searched password is calling, switch to a speech recognition mode for calling, and wherein the controller is further configured to, if the function corresponding to the searched password is playing music, switch to a speech recognition mode for playing music.

17. An unlocking method using an ear-micro headset in a terminal, the method comprising:

plugging the ear-micro headset into the terminal;

outputting a voice command to request entering a password for unlocking the terminal if the terminal is locked with the ear-micro headset plugged therein;

unlocking the terminal based on inputs of at least one button equipped in the ear-micro headset, the inputs being used as the password after the voice command is output; and switching to a speech recognition mode corresponding to input of a button among a plurality of speech recognition modes based on the input of the button equipped in the ear-micro headset if the terminal is unlocked with the ear-micro headset plugged therein.

18. The method of claim 17, wherein the unlocking of the terminal includes switching to a speech recognition mode.

19. The method of claim 17, wherein the unlocking of the terminal is performed when a button for unlocking the terminal among the at least one button equipped in the ear-micro headset has been pressed for more than a predetermined period of time.

20. The method of claim 17, wherein the unlocking of the terminal comprises:

receiving at least one resistance value assigned to the at last one button equipped in the ear-micro headset;

comparing the received at least one resistance value with a predetermined password value; and unlocking the terminal if the received at least one resistance value matches the predetermined password value.

21. The method of claim 17, wherein the unlocking of the terminal comprises, if the ear-micro headset is equipped with a single button, each time the single button is pressed, unlocking the terminal according to intervals of reception of a resistance value assigned to the single button.

22. The method of claim 17, further comprising, in a password setting mode for unlocking the terminal using the ear-micro headset, storing at least one resistance value assigned to the at least one button equipped in the ear-micro headset in the non-transitory memory as password values to unlock the terminal.

23. The method of claim 17, further comprising, if a button of the at least one button equipped in the ear-micro headset for unlocking the terminal has been pressed for more than a predetermined period of time while the terminal is unlocked with the ear-micro headset plugged therein, switching to a speech recognition mode.

24. The method of claim 17, wherein the unlocking of the terminal further comprises:

outputting the voice command to request entering the password for unlocking the terminal, if a resistance value assigned to a button of the at least one button equipped in the ear-micro headset for unlocking the terminal has been received for more than a predetermined period of time while the terminal is locked with the ear-micro headset plugged therein;

upon reception of at least one resistance value assigned to the at least one button equipped in the ear-micro headset, comparing the received at least one resistance value with a predetermined password value stored in advance; and unlocking the terminal if the received at least one resistance value matches the predetermined password value stored in advance.

25. The method of claim 24, further comprising, if a button of the at least one button equipped in the ear-micro headset for unlocking the terminal has been pressed for more than a predetermined period of time while the terminal is unlocked with the ear-micro headset plugged therein, switching to a speech recognition mode.

26. The method of claim 17, wherein the unlocking of the terminal further comprises:

determining a type of the speech recognition mode based on a resistance value assigned to a particular button of the at least one button equipped in the ear-micro headsets;

outputting a voice command to request entering a password for unlocking the terminal, if the resistance value assigned to the particular button has been received for more than a predetermined period of time while the terminal is locked with the ear-micro headset plugged therein;

upon reception of at least one resistance value assigned to the at least one button of the ear-micro headset, comparing the received at least one resistance value with a predetermined password value stored in a non-transitory memory; and unlocking the terminal and switching to a speech recognition mode for performing a function corresponding to the particular button if the received at least one resistance value matches the predetermined password value stored in the non-transitory memory.

27. The method of claim 26, further comprising switching to the speech recognition mode for performing a function corresponding to the particular button if the particular button has been pressed for more than a predetermined period of time while the terminal is unlocked.

28. The method of claim 26, wherein the switching to the speech recognition mode for performing the function corresponding to the particular button comprises:

switching to a speech recognition mode for calling if the function corresponding to the particular button is calling; and switching to a speech recognition mode for music play, if the function corresponding to the particular button is playing music.

29. The method of claim 17, wherein unlocking of the terminal comprises:

outputting a voice command to request entering a password for unlocking the terminal, if a resistance value assigned to a button of the at least one button equipped in the ear-micro headset for unlocking the terminal has been received for more than a predetermined period of time while the terminal is locked with the ear-micro headset plugged therein;

upon reception of at least one resistance value assigned to the at least one button of the ear-micro headset; searching for a password value that matches the received at least one resistance value among password values stored in advance; and unlocking, if the password value matches the received at least one resistance value, the terminal and switching to a speech recognition mode for performing a function corresponding to the searched password value.

30. The method of claim 29, further comprising, if a button for unlocking the terminal has been pressed for more than a predetermined period of time while the terminal is unlocked with the ear-micro headset plugged therein, switching to the speech recognition mode.

31. The method of claim 29, wherein the switching to the speech recognition mode for performing the function corresponding to the searched password value comprises:

switching to a speech recognition mode for calling if the function corresponding to the searched password value is calling; and switching to a speech recognition mode for music play, if the function corresponding to the searched password is playing music.

32. An apparatus disposed in a mobile terminal for unlocking the mobile terminal, the apparatus comprising:

a non-transitory memory storing at least one password value configured to unlock the mobile terminal, and to switch the mobile terminal to a speech recognition mode according to an input value entered through a headset connected to the mobile terminal; and a controller electrically connected to the non-transitory memory configured to:

output a voice command to request entering a password for unlocking the terminal if the terminal is locked with the ear-micro headset plugged therein unlock the mobile terminal when the input value entered through the headset matches the at least one password value stored in the non-transitory memory of the mobile terminal, and switch to a speech recognition mode corresponding to the input value among a plurality of speech recognition modes if the mobile terminal is unlocked with the headset plugged therein.

* * * * *